United States Patent [19]

Fukui

[11] 4,145,009

[45] Mar. 20, 1979

[54] IMPACT TYPE CRUSHER

[75] Inventor: Hirokazu Fukui, Katanoshi, Japan

[73] Assignee: Kubota Kekko Kabushiki Kaisha, Osaka, Japan

[21] Appl. No.: 826,216

[22] Filed: Aug. 19, 1977

[30] Foreign Application Priority Data

Mar. 14, 1977 [JP] Japan ..... 52-28392
Mar. 14, 1977 [JP] Japan ..... 52-28393

[51] Int. Cl.[2] ..... B02C 13/26

[52] U.S. Cl. ..... 241/194; 241/238; 241/292

[58] Field of Search ..... 241/37, 188 R, 189 R, 241/189 A, 190, 191, 194, 238, 286–288, 292

[56] References Cited

U.S. PATENT DOCUMENTS

| | | | |
|---|---|---|---|
| 1,581,684 | 4/1926 | Ogden | 241/238 |
| 2,829,692 | 4/1958 | Innocenti | 241/37 X |
| 3,135,307 | 6/1964 | Blanshine | 241/238 |
| 3,252,664 | 5/1966 | Roygemont | 241/238 |

FOREIGN PATENT DOCUMENTS

| | | | |
|---|---|---|---|
| 1131973 | 6/1962 | Fed. Rep. of Germany | 241/191 |

*Primary Examiner*—Howard N. Goldberg
*Attorney, Agent, or Firm*—Griffin, Branigan and Butler

[57] ABSTRACT

An impact crusher includes a shell housing, a main drive shaft, a first member mounted on the shaft, and a second member carried on and rotatable with respect to the first member. Impact members act against the inner lining of the housing to crush the material. The impact gap between the impact members and the housing lining is variable in a stepless fashion by a drive mechanism which rotates the first member relative to the second member to thereby drive the impact members radially. In one embodiment each impact member is driven by a pin which extends through the impact member and overlapping elongated holes in the first and second members. In other embodiments, a plurality of linking elements are employed. Weights may be provided to counter-balance the forces in the crusher resulting from the centrifugal forces of the impact members. These weights may also serve as an alternate set of impact members usable when the normal impact members become worn.

6 Claims, 17 Drawing Figures

IMPACT TYPE CRUSHER

BACKGROUND OF THE INVENTION

This invention relates to an impact type crusher for crushing by means of shearing, compressing or grinding. The invention is generally useful in crushing such materials as aggregates, industrial refuse, solid wastes, garbage, and general waste material.

Crushers of this type generally comprise a main shaft which is rotatably driven by a motor or prime mover, the shaft being generally disposed coaxial to a shell housing. Percussion members such as breakers, hammers, or the like are carried for rotation about the main shaft and, with a liner portion of the shell housing define an impact gap. The material to be crushed is passed through this gap. During normal usage, the faces of the impact members become worn thus increasing the impact gap. This results in the crushed material being more coarse than is desired.

BRIEF DESCRIPTION OF THE INVENTION

An object of the present invention is to provide an impact type crusher including a shell housing, a main shaft disposed axially in the shell housing, an impact gap modulating means mounted on the main shaft for rotation therewith, and a plurality of impact members mounted on the modulating means, the modulating means including means for moving the impact members radially with respect to the main shaft to vary the impact gaps between the outer faces of the impact members and the inner side of the shell housing.

Another object of the invention is to provide an impact crusher as described above wherein the modulating means comprises a first member mounted on the main shaft, a second member rotatable about the main shaft, a plurality of pairs of links, a first end of the two links of a pair being pivotally connected respectively to the first and second members, a plurality of support shafts, the impact members being supported on an overlapped portion of the other ends of the two links of a pair by one of the support shafts, and a drive means disposed between the first and second members to rotate the second member about the main shaft.

A further object of the invention is to provide a crusher as described above which also includes a plurality of further links, the first ends of the links of the pairs being connected to respective first ends of two of the further links, the respective other ends of each two further links being overlapped, a plurality of balance weights, and a plurality of pins, one pin extending through one of the balance weights and the overlapped ends of two of the further links.

A further object of the invention is to provide a crusher as described above wherein the balance weights are further impact members whereby the impact members or the balance weights may alternately serve as the percussion members of the crusher.

A further object of the invention is to provide an impact type crusher comprising a shell housing, a rotatable main shaft disposed axially in the shell housing, an impact gap modulating means mounted on the shaft for rotation therewith, a plurality of impact members mounted on the modulating means, the modulating means comprising a first member mounted on the main shaft, a second member supported rotatably about the main shaft, the first and second members being pierced with apertures, and a shaft extending through each impact member and the through-hole formed by overlapping apertures in the first and second members, and a drive means disposed between the first and second members for rotating one of the first and second members relative to the other.

Other objects of the invention and its mode of operation will become apparent upon consideration of the following description and the accompanying drawings.

DETAILED DESCRIPTION OF THE INVENTION

FIGS. 1–4 show an impact crusher having an impact gap modulating assembly 1. The impact gap modulating assembly comprises a main shaft 2, a first member 3 and a second member 4. Main shaft 2 is rotated by a motor or prime mover (not shown). The first member 3 is mounted on shaft 2 for rotation therewith. Member 3 is spool-like in shape including upper and lower disc portions **3*a* and 3*b* connected by a tubular member 3*c*. In like manner, the second member 4 is a spool-like member having upper and lower disc portions 4*a* and 4*b* interconnected by a tubular portion 4*c***.

Figure 2:
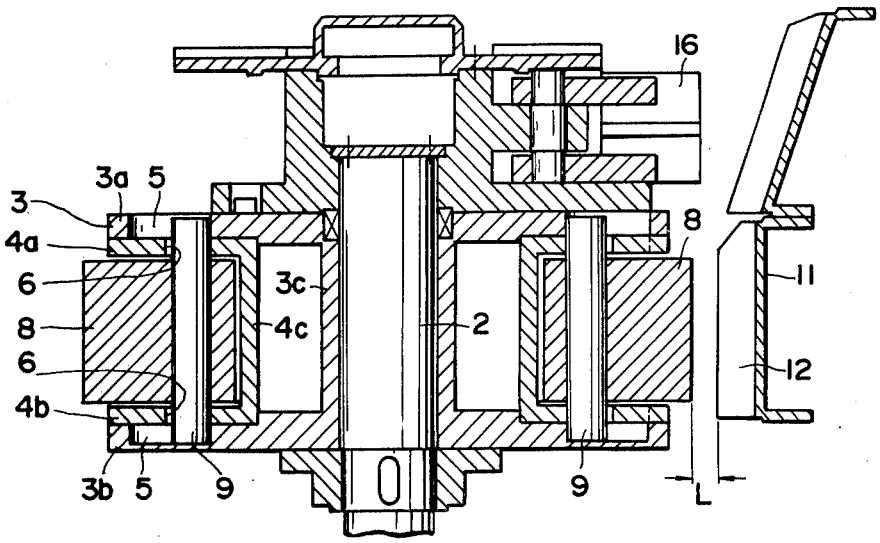
FIG. 2 is a sectional view taken along the line II—II of FIG. 1.
Figure 3:
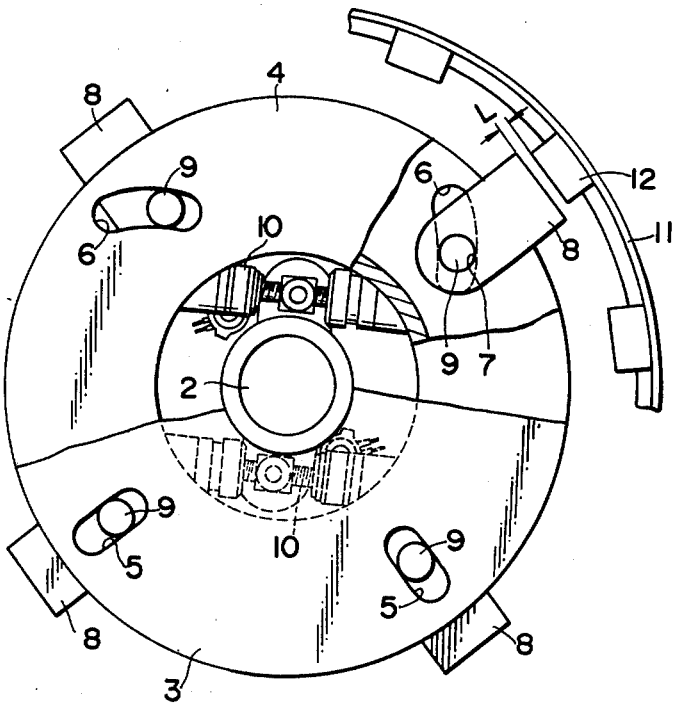
FIG. 3 is similar to FIG. 1 but illustrates the impact members in an extended position.
Figure 4:
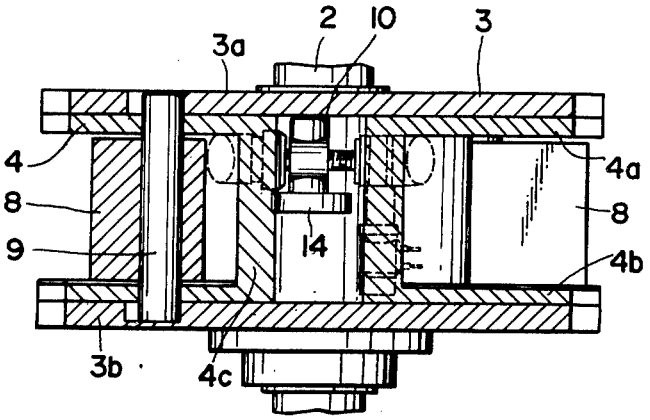
FIG. 4 is a sectional view taken along the line IV—IV of FIG. 1.

The second member 4 is mounted on the first member 3 and is rotatable relative thereto, the discs 3*a* and 3*b* having annular thickened regions which serve as the locating bearings for the second member. The upper and lower discs 3*a* and 3*b* are each provided with a plurality of apertures 5 equidistantly spaced around the discs. Apertures 5 are elongated and extend radially outwardly toward the periphery of the discs. The apertures 5 in disc 3*a* extend completely through the disc whereas the apertures 5 in the disc 3*b* extend only partly through the disc from the upper surface thereof so that the apertures in this disc have a bottom wall as illustrated in FIG. 2.

The upper and lower discs 4*a* and 4*b* of the second member are provided with a plurality of equidistantly spaced arcuate apertures 6. The apertures 6 extend completely through the discs 4*a* and 4*b*. Therefore, a support pin 9 may be inserted through an aperture 5 in disc 3*a*, an aperture 6 in disc 4*a*, an opening in an impact or percussion member 8, and an aperture 6 in disc 4*b* to be received in an aperture 5 in disc 3*b* and supported by the bottom wall of the aperture in the disc 3*b*.

Impact members 8 cooperate with a plurality of liner elements 12 to crush the material being handled. The crusher is provided with a shell housing 11 which is concentrically located with respect to the drive shaft 2 and the liner elements 12 are attached to the shell housing 11. The spacing "L" between impact members 8 and liner elements 12 defines the impact gap. It frequently becomes necessary to adjust the impact gap such as, for instance, when the faces of the impact members 8 become worn.

Figure 1:
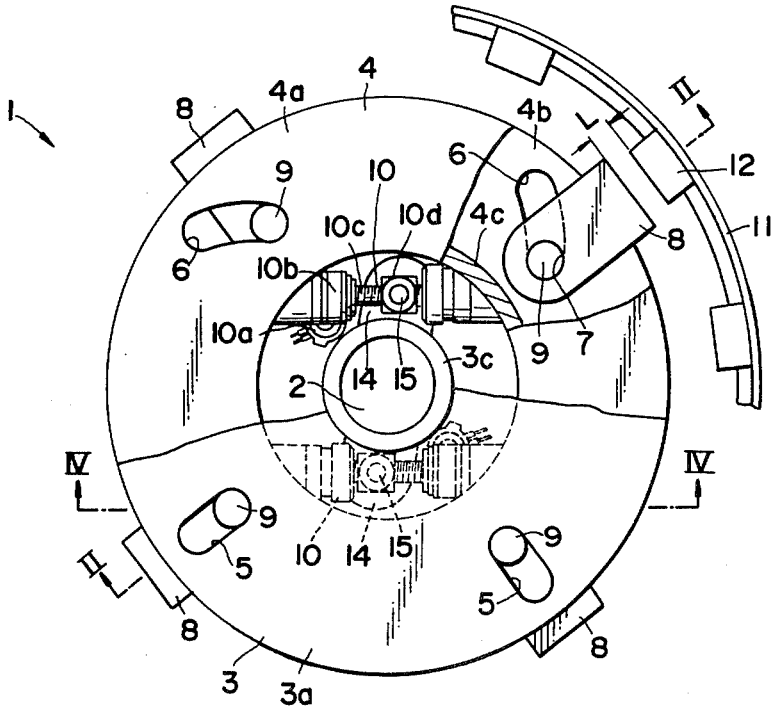
FIG. 1 is a partial top view of an impact crusher, the view being partially cut away to illustrate how apertures in two members rotatable relative to each other may be utilized to drive impact members radially.
Figure 9:
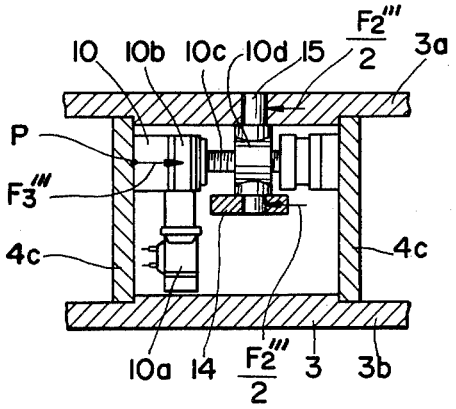
FIG. 9 is a sectional view taken along the line IX—IX of FIG. 5.

The impact gap is adjusted by rotating the second member 4 relative to the first member 3. One or more drive means 10 is/are provided for this purpose. As best illustrated in FIGS. 1 and 9, each drive means 10 comprises a motor 10*a*, which is preferably a fluid motor, a worm-type reducer 10*b*, a screw 10*c* and a screw boss 10*d*. Boss 10*d* is connected to a pin 15. Pin 15 is supported at one end by the disc 3*a* and at the other end by bracket 14 which projects from tubular portion 3*c* of the first member 3. Reducer 10*b* is secured to the tubular member 4*c* of second member 4. Screw 10*c* extends from reducer 10*b* and at its opposite end is rotatably mounted in a support means attached to the tubular portion 4*c*.

Assuming that the impact members 8 are fully retracted as illustrated in FIG. 1, the impact gap L may be reduced in dimension as follows. The fluid motor 10 is activated and, through reducer 10*b* drives screw 10*c*. The position of screw boss 10*d* is fixed relative to the first member 3 by the pin 15. Therefore, as screw 10*c* is rotated, a force is exerted against the tubular portion 4*c* of the second member 4, this force tending to rotate second member 4 in the clockwise direction as viewed in FIG. 3. As this occurs, the holes 7 formed by overlapping apertures 5 and 6 move radially outwardly. Since pins 9 are carried in the thus defined holes 7, the pins 9 are driven outwardly thus radially moving the impact members 8 outwardly toward liner elements 12. As the impact members 8 are moved outwardly, the impact gap L is reduced. Modulation of the impact gap L in no way affects preliminary breaker 16 which is pivoted to a body attached to shaft 2.

FIGS. 5–8 illustrate a second embodiment of the impact gap modulating means 1 wherein a plurality of links 17 and 18 are provided for driving the impact members 8 in response to actuation of the drive means 10. In this embodiment, the first member 3 comprises two vertically spaced discs 3*a* and 3*b* connected together by a tubular portion 3*c* which is attached to and rotates with the drive shaft 2. Second member 4 comprises a tubular portion 4*c* disposed coaxially to and guided by the first member 3, and a plurality of upper brackets 4*d* and lower brackets 4*e* radially projecting from the tubular portion 4*c*. The number of brackets 4*d* or 4*e* is equal to the number of impact members 8. As with the first embodiment, the second member 4 is positioned between the discs 3*a* and 3*b* of the first member 3.

Figure 8:
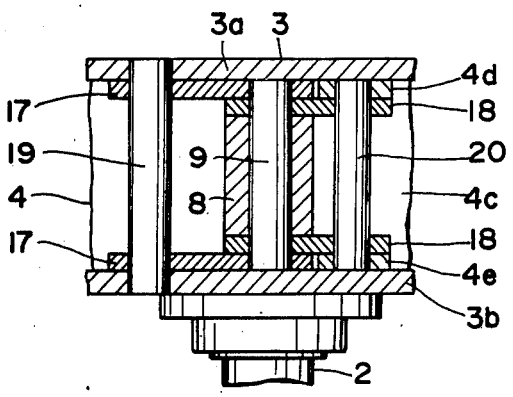
FIG. 8 is a sectional view taken along the line VIII—VIII of FIG. 5.

Each link 17 or 18 has a hole extending therethrough near each end of the link. The discs 3*a* and 3*b* each have a plurality of apertures extending therethrough and a pin 19 extends through each of these apertures. As best illustrated in FIG. 8, a pin 19 extends through the hole in one end of a pair of links 17, one of the links being located adjacent the lower surface of disc 3*a* and the other link of the pair being located adjacent the upper surface of the disc 3*b*.

Each of the brackets 4*d* and 4*e* has a hole therein for receiving a pin 20. Each pin 20 extends through the opening in one end of each of the links 18, there being a link 18 positioned beneath each bracket 4*d* and another link 18 positioned above each bracket 4*e*. A pin 9 is provided for connecting one pair of links 17 with one pair of links 18. As shown in FIG. 8, each pin 9 extends through a link 17, a link 18, a hole in an impact member 8, another link 18, and a further link 17.

Figure 5:
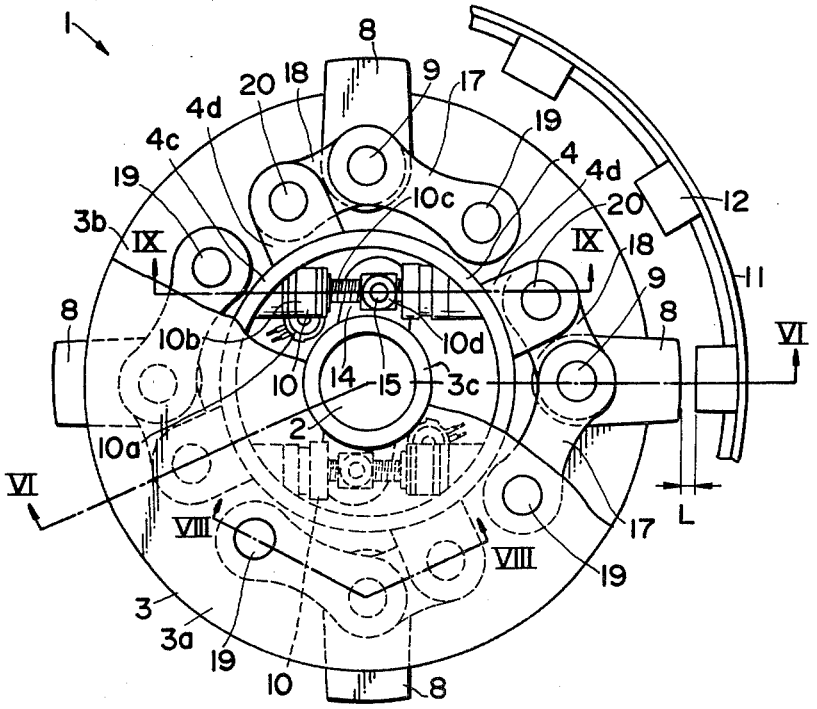
FIG. 5 is a top view of a second embodiment of the invention.
Figure 6:
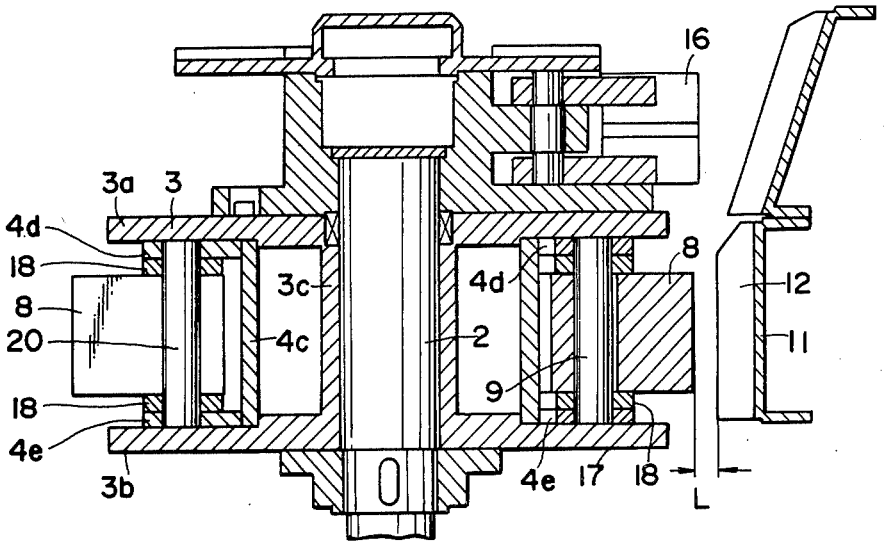
FIG. 6 is a sectional view taken generally along the line VI—VI of FIG. 5.
Figure 7:
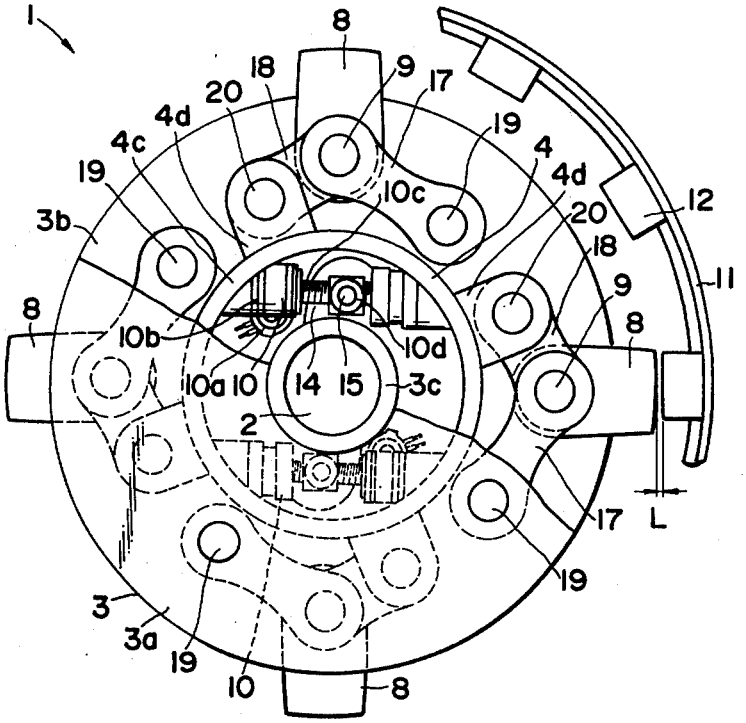
FIG. 7 is a view similar to FIG. 5 but illustrating the impact members in an extended position.

A drive means 10 such as that previously described may be employed to vary the impact gap L of FIG. 5. As in the previous embodiment, the fluid motor 10*a* is activated and through reducer 10*b* drives the screw 10*c*. Since the screw boss 10*d* is fixed relative to the first member 3 by the pin 15 as illustrated in FIG. 9, rotation of screw 10*c* rotates second member 4 relative to the first member 3. As illustrated in FIG. 8, the pins 19 are fixed relative to the first member 3. With this in mind, and turning now to FIG. 7, it is seen that as the second member 4 is rotated relative to the first member 3 the impact members 8 are moved in a radial direction. If the direction of this rotation is clockwise as viewed in FIG. 7, the motion of second member 4 is transmitted through brackets 4*d* and 4*e*, pins 20, links 18, and pins 9 to the impact members 8. Pins 9 are driven generally in the radial direction because fixed pins 19 and links 17 prevent movement of the pins 9 in any other direction.

Figure 10:
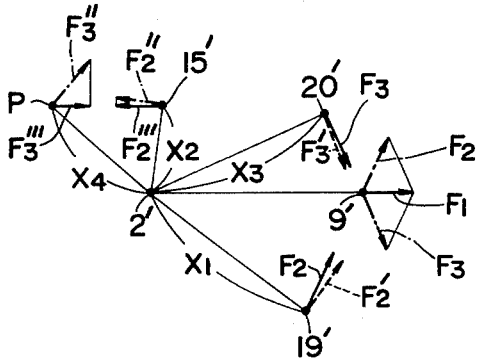
FIG. 10 is a force diagram depicting the forces generated at various locations within an impact member as a result of the centrifugal forces generated by rotating the impact members.
Figure 11:
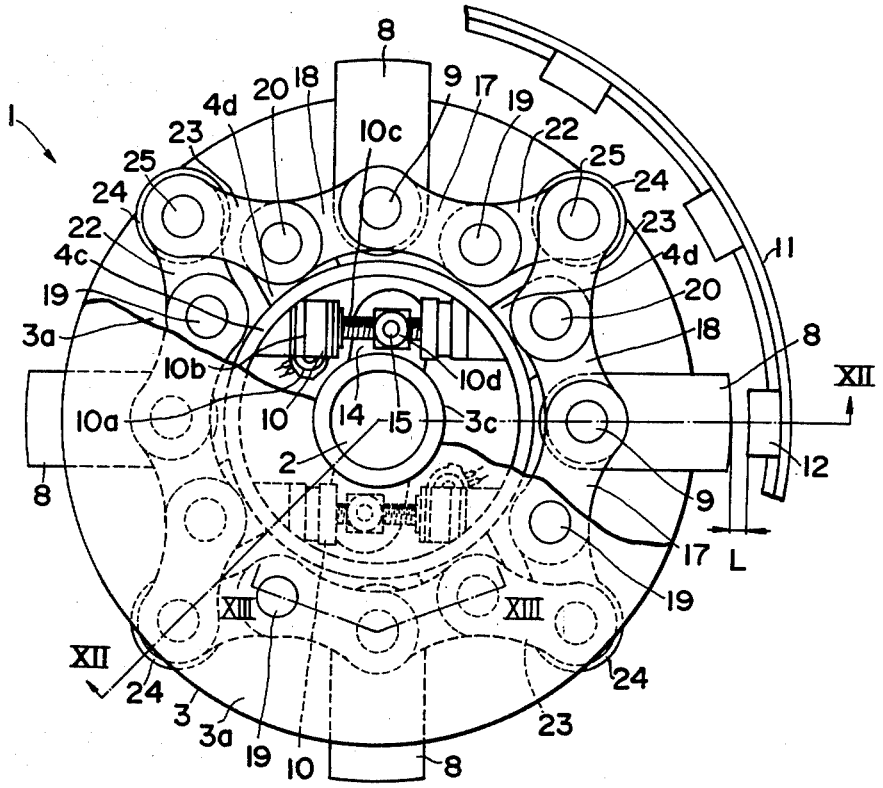
FIG. 11 is a top view of a further embodiment of the invention and illustrating an arrangement of balance weights as they might appear when the impact members are drawn inwardly to their maximum extent.

The embodiment of FIGS. 5–8 has a disadvantage in that when main shaft 2 is rotated a compressive force is generated which compresses the drive means 10 in a direction axial to its mounting thereby causing damage to the drive means. Referring to FIG. 10, the forces which tend to cause this damage may be analyzed as follows. Rotation of the impact members 8 results in a centrifugal force $F_1$ at center 9' of the pin 9. The force $F_1$ is divided into two components, $F_2$ which is transmitted through links 17 to the center 19' of pin 19, and $F_3$ which is transmitted through links 18 to the center 20' of pin 20. Since the components $F_2$ and $F_3$ are in different directions pins 19 and 20 will be drawn toward each other. This results in a revolving moment in the counter-clockwise direction being applied to the first member 3 which supports pin 19 whereas another revolving moment in the clockwise direction is applied to second member 4 which supports pin 20. Since the drive means 10 is disposed between the first and second members 3 and 4 these revolving moments apply a compressive force to the drive means 10 generally axially of its mounting direction. More particularly, a first revolving moment occurring at pin 19 is equal to the product of a tangential component force $F'_2$ of component $F_2$ and a distance $X_1$ which is measured from the center 2' of main shaft 2 to the center 19' of pin 19. On the other hand, a second revolving moment occurring at pin 20 is equal to the product of a tangential component force $F'_3$ of component $F_3$ and by a distance $X_3$ which is measured from the center 2' of main shaft 2 to the center 20' of pin 20. As a result of the first and second revolving forces, a force $F''_2$ occurs at the center 15' of pin 15 as a one-side supporting point of drive means 10 carried by the first member 3. $F''_2$ is equal to $F'_2 \times X_1/X_2$ with $X_2$ being the distance from the center of shaft 2 to the center of pin 15. The first and second revolving forces also generate a tangential force $F''_3$ which occurs at a fixed point P as the other side supporting point of the drive means affixed to the second member 4. $F''_3$ is equal to $F'_3 \times X_3/X_4$ with $X_4$ being the distance from the center 2' of shaft 2 to the point P. Tangential forces $F''_2$ and $F''_3$ are replaced with the forces operable upon the respective axial directions of drive means 10 to gain opposed forces $F'''_2$ and $F'''_3$ thereby generating a compressive force which is operable to clamp drive means 10 under pressure. Since the drive means 10 is disposed in a narrow space between tubular portion 3c of first member 3 and tubular portion 4c of second member 4, large or heavy parts cannot be used. Thus, as illustrated in FIG. 9, the opposing forces $F'''_2$ and $F'''_3$ tend to bend pin 15 while applying bending moments and shearing stresses to pin 15, disc 3a and bracket 14.

The foregoing analysis is concerned with a simple case of a single impact member driven by a single drive means 10. For other cases, the forces $F'''_2$ and $F'''_3$ should be multiplied by a factor M/D where M is the number of impact members 8 and D is the number of drive assemblies 10.

Figure 12:
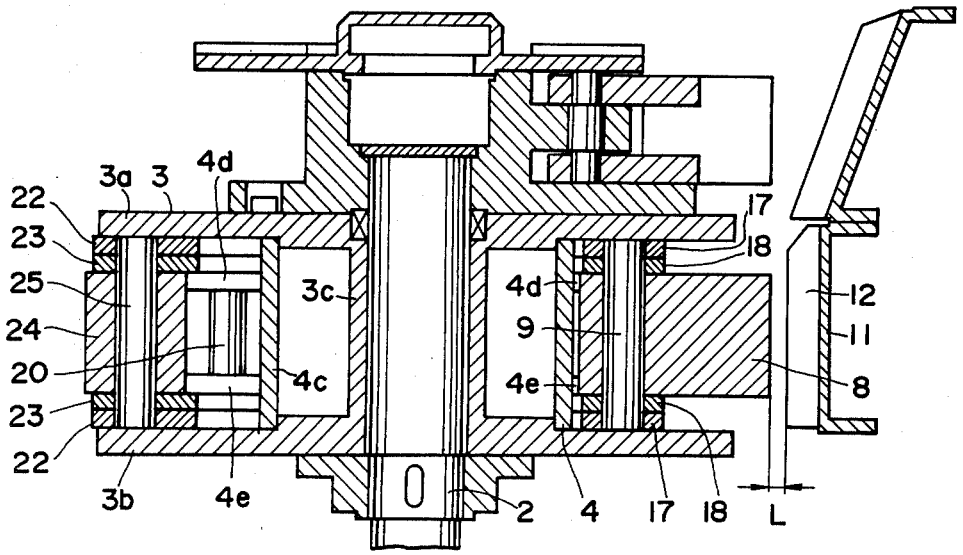
FIG. 12 is a sectional view taken along the line XII—XII of FIG. 11.
Figure 13:
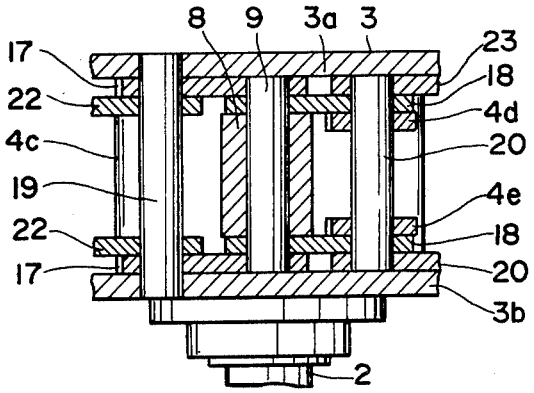
FIG. 13 is a sectional view taken along the line XIII—XIII of FIG. 11.

From the foregoing analysis it is obvious that the embodiment of FIGS. 5–8 requires a relatively large space and particularly reinforced supporting materials in order to prevent destruction of the drive means 10 by strong compressive and shearing forces resulting from the centrifugal forces generated as impact members 8 are rotated. The embodiment illustrated in FIGS. 11–14 overcomes this disadvantage by including further links 22 and 23, balance weights 24, and pivot pins 25. As shown in FIG. 13, one end of each link 22 is connected with a link 17 and the first member 3 by a pin 19. One end of each link 23 is connected with a link 18 and brackets 4d and 4e of second member 4 by a pin 20 as shown in FIG. 12, the respective other ends of links 22 and 23 are overlapped and joined together by a pivot pin 25 which also extends through a balance weight 24. As is evident from FIG. 13, each pin 19 connects together two links 22 and two links 17 whereas each pin 20 connects together two links 23 and two links 18.

Adjustment of the impact gap in the embodiment of FIGS. 11–14 is accomplished in exactly the same manner as the embodiments of FIGS. 5–8. However, the additional links 22 and 23 together with balance weights 24 provide a means for preventing damage to the drive means 10 as result of the forces generated during rotation of the impact members 8. This is accomplished by utilizing balance weights 24 which generate centrifugal forces when they are rotated about main shaft 2, these centrifugal forces balancing the centrifugal forces generated by impact members 8.

Figure 14:
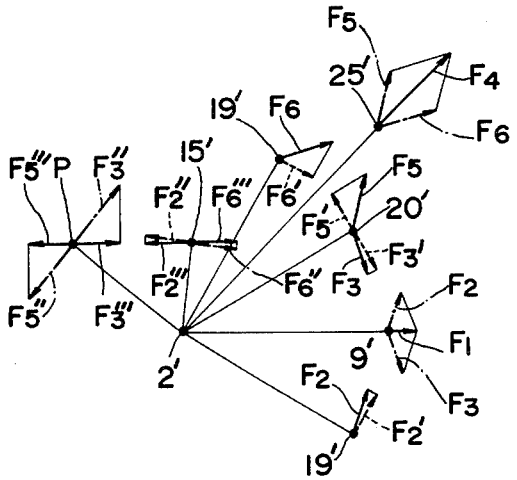
FIG. 14 is a force diagram illustrating the various loads at different points in the crusher resulting from the centrifugal forces generated by rotating the impact members and balance weights.

FIG. 14 is a force diagram illustrating the forces occurring at various points in the system as a result of rotation of a single balance weight 24 and a single impact member 8. The forces resulting from rotation of impact members 8 about shaft 2 are essentially the same as in the previous embodiment and thus are essentially the same as illustrated in FIG. 10. Rotation of a balance weight 24 about shaft 2 generates a centrifugal force $F_4$ at the center 25' of pin 25 and this force is resolved into two components $F_5$ and $F_6$ in the links 22 and 23. As a result, a tangential force $F'_5$ occurs at center 20' of pin 20 and another tangential force $F'_6$ occurs at the center 19' of pin 19. These forces, in turn, generate tangential forces $F''_5$ and $F''_6$. The force $F''_5$ creates a force $F'''_5$ at the point P (FIG. 9) which acts in the axial direction of the drive mechanism 10. The force $F''_6$ generates a force $F'''_6$ at the pin 15. Consideration of FIG. 14 shows that the tangential force $F'_2$ resulting from impact member 8 and occurring at pin 19 is counter-clockwise whereas the force $F'_6$ occurring at pin 19 as result of the rotation of weight 24 is in the clockwise direction. Thus, these forces offset each other at the pin 19. In like manner, the forces $F'_3$ and $F'_5$ resulting from rotation of a member 8 and a weight 24, respectively, and occurring at pin 20, also balance each other. Furthermore, the forces $F'''_2$ and $F'''_6$ occurring at pin 15 tend to balance each other while the forces $F'''_5$ and $F'''_3$ occurring at the point P also tend to balance each other. Thus, by properly choosing the weight and dimensions of weights 24 and links 22 and 23 a balanced system may be obtained which to a large degree eliminates any forces on the pins 15, 19, and 20 and the point P that might otherwise result from the centrifugal force generated by rotating impact members 8.

Figure 17:
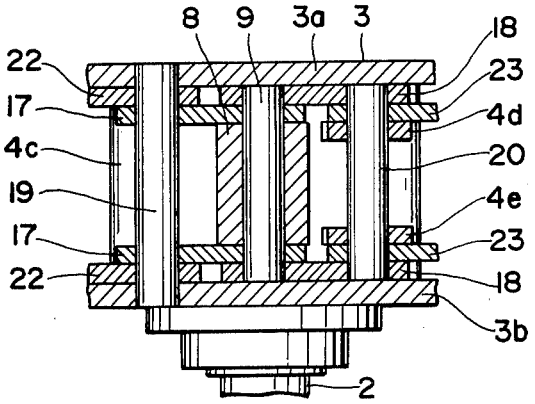
Figure 15:
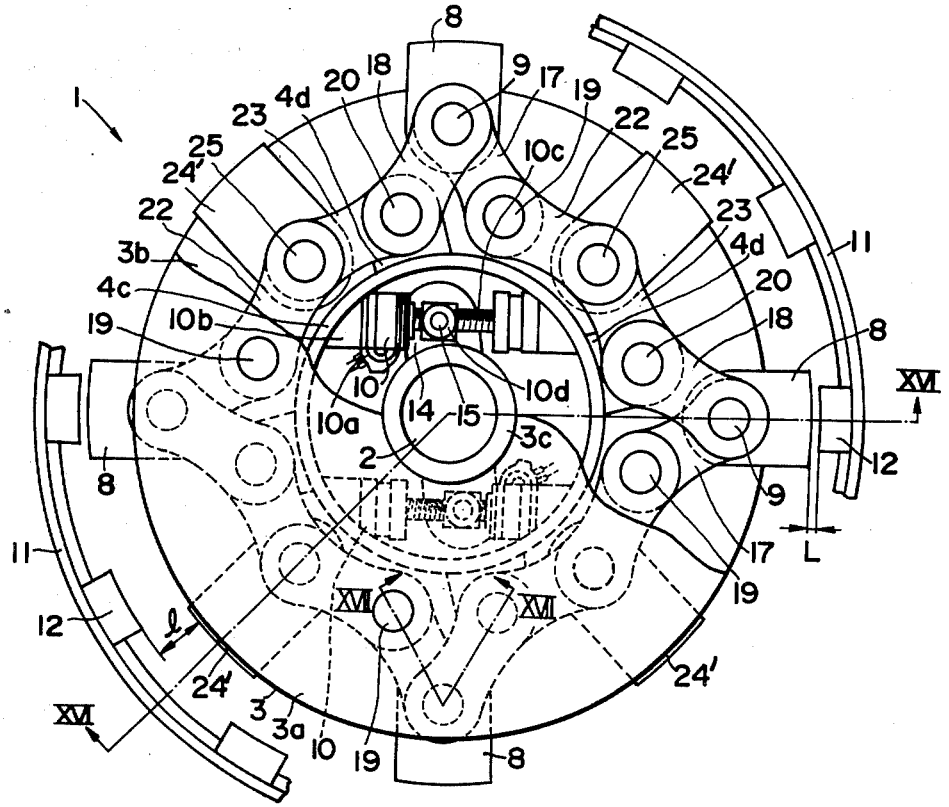
FIG. 15 is a top view of a further embodiment of the invention wherein balance weights may also serve as an alternate set of impact members which are placed in use after the normal impact members have become worn.
Figure 16:
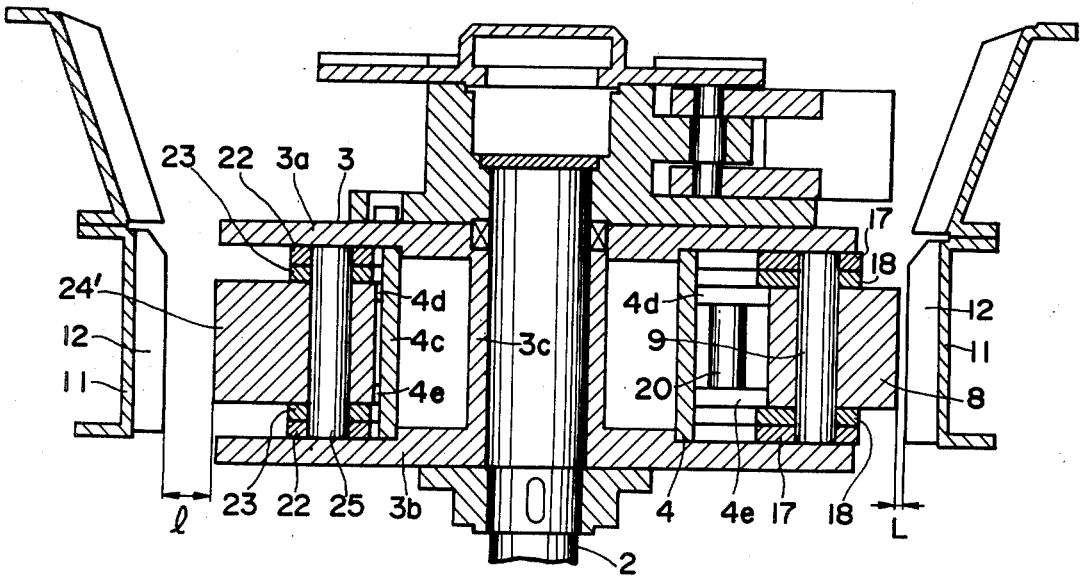
FIG. 16 is a sectional view taken along the line XVI—XVI of FIG. 15; and, FIG. 17 is a sectional view taken along the line XVII—XVII of FIG. 15.

FIGS. 15–17 illustrate a further embodiment of the invention wherein balance weights 24 may serve the dual function of counter-balance weights and preparatory percussion or impact members. From the description of the preceding embodiment, and from inspection of FIG. 15, it is evident that as a second member 4 is rotated in the clockwise direction relative to first member 3 then the impact members 8 are progressively extended while the preparatory impact members 24' are progressively retracted. As illustrated in FIG. 15, preparatory impact members 24' are retracted a distance l from the liner elements 12. The distance l is greater than the distance L, L representing a desired impact gap. As the impact members 8 are worn away during a crushing operation, the drive mechanism 10 is activated to rotate second member 4 clockwise relative to first member 3 thereby further extending impact members 8 and keeping the impact gap L constant. When the impact members 8 are completely worn and require replacement, the drive mechanism 10 is activated to rotate second member 4 counter-clockwise relative to first member 3. This retracts the impact members 8 and extends the preparatory impact members 24'. The drive mechanism 10 is driven to adjust the distance between preparatory impact members 24' and liner elements 12 to be equal to the desired impact gap L. The crushing operation may then be continued with preparatory impact members 24' operating as the crushing members and the impact members 8 operating as the counter-balance weights. Thus, the crushing apparatus may be operated for twice as long a period of time without halting the crushing operation for replacement of the impact members.

From the foregoing description it is seen that the present invention provides an impact crusher having a gap modulating assembly for modulating the impact gap in a continuous (as opposed to step-wise) manner. The impact gap may be adjusted immediately, hence, crushed objects of uniform size are obtained at all times. By providing counter-balance weights the impact gap modulating mechanism may be made more compact and may utilize smaller parts than would otherwise be the case. Furthermore, the crushing operation need not be suspended as often for replacement of impact members since counter-balance weights may also serve as a second set of impact members.

While preferred embodiments of the invention have been described in specific detail, it will be obvious to those skilled in the art and others that various substitutions and modifications may be made in the embodiments illustrated. For example, the drive means 10 may be driven by a hand-jack rather than a fluid motor. The impact members 8 may be hammers or breaker elements. Furthermore, the principles of the invention are applicable to crushing machines other than those of the vertical drive shaft type. It is intended therefore to be limited only by the scope of the appended claims.

I claim:

1. An impact type crusher comprising:

a shell housing;

a rotatable main shaft disposed axially in said shell housing;

an impact gap modulating means mounted on said shaft for rotation therewith;

a plurality of impact members mounted on said modulating means, and disposed radially about said main shaft; and, said modulating means including means for moving simultaneously and to the same extent, all of said impact members radially of said shaft to simultaneously vary to the same extent all of the impact gaps between the outer faces of said impact members and the inner side of said shell housing.

2. A crusher as claimed in claim 1, wherein said modulating means comprises a first member mounted on said main shaft, and a second member supported rotatable around the main shaft, said first and second members being pierced each with apertures and a shaft extending through each impact member and the through hole formed by overlapping apertures in said first and second members; and a drive means disposed between said first and second members for rotating one of said first and second members relative to the other.

3. A crusher as claimed in claim 1, wherein said modulating means comprises a first member mounted on the main shaft; a second member rotatable about said main shaft; a plurality of pairs of links, a first end of the two links of a pair being pivotably connected respectively to said first member and said second member; a plurality of support shafts, said impact members being supported on an overlapped portion of the other ends of the two links of a pair by one of said support shafts; and, a drive means disposed between said first and second members to rotate said second member about said main shaft.

4. A crusher as claimed in claim 3 and further comprising a plurality of further links each of said further links having a first end overlapped with the first end of another of said further links, and a second end pivotally connected to a first end of one of said links of said plurality of pairs of links; a plurality of balance weights; and a plurality of pins, one pin extending through one of said balance weights and the overlapped first ends of two of said further links.

5. A crusher as claimed in claim 4, wherein said balance weights are further impact members whereby either said impact members or said further impact members may serve as the percussion members of said crusher.

6. A crusher as claimed in claim 1 wherein said modulating means comprises means for simultaneously steplessly varying said impact gaps.

* * * * *